US009451829B2

(12) United States Patent
Chen

(10) Patent No.: US 9,451,829 B2
(45) Date of Patent: Sep. 27, 2016

(54) FOLDABLE CHAIR FRAME

(71) Applicant: Te-Lung Chen, Tainan (TW)

(72) Inventor: Te-Lung Chen, Tainan (TW)

( * ) Notice: Subject to any disclaimer, the term of this patent is extended or adjusted under 35 U.S.C. 154(b) by 0 days.

(21) Appl. No.: 14/666,364

(22) Filed: Mar. 24, 2015

(65) Prior Publication Data

US 2016/0135600 A1 May 19, 2016

(30) Foreign Application Priority Data

Nov. 14, 2014 (TW) ..... 103139597 A

(51) Int. Cl.
*A47C 4/28* (2006.01)
*A47C 1/026* (2006.01)

(52) U.S. Cl.
CPC ..... *A47C 4/286* (2013.01); *A47C 1/0265* (2013.01)

(58) Field of Classification Search
CPC ..... A47C 4/286; A47C 7/54; A47C 1/0265
USPC ..... 297/28, 42
See application file for complete search history.

(56) References Cited

U.S. PATENT DOCUMENTS 2,690,792 A * 10/1954 Moss ..... A47C 4/286 297/42
6,062,648 A * 5/2000 Adler ..... A47C 4/02 297/42
7,641,276 B1 * 1/2010 Chen ..... A47C 4/286 297/42
2015/0359339 A1 * 12/2015 Choi ..... A47C 4/286 297/42

FOREIGN PATENT DOCUMENTS

GB 637079 A * 5/1950 ..... A47C 4/286

* cited by examiner

*Primary Examiner* — Anthony D Barfield
(74) *Attorney, Agent, or Firm* — Alan D. Kamrath; Kamrath IP Lawfirm, P.A.

(57) ABSTRACT

A foldable chair frame includes two spaced leg units, two spaced backrest units, a connecting unit, and a linkage unit. Each of the leg units includes a front leg and a rear leg. The connecting unit is pivotally connected between the leg units. The linkage unit includes at least one link module pivotally connected between the backrest units. The link module includes two links each having a first pivot portion pivotally connected with one of the backrest units and a second pivot portion located opposite to the first pivot portion. Thus, the foldable chair frame is folded in its longitudinal direction and is also folded in its transverse direction to reduce its whole volume to the minimum.

8 Claims, 9 Drawing Sheets

FOLDABLE CHAIR FRAME

BACKGROUND OF THE INVENTION

1. Field of the Invention

The present invention relates to a chair frame and, more particularly, to a chair frame that can be expanded and collapsed.

2. Description of the Related Art

A conventional foldable chair comprises two front legs, two rear legs, a backrest, a seat, and two armrests. When the user wishes to fold the chair, the front legs and the rear legs are moved to approach each other, while the backrest, the seat and the armrests are moved toward each other so as to reduce the volume of the folded chair. However, the conventional foldable chair is only folded in its longitudinal direction and cannot be folded in its transverse direction so that the width of the folded chair is not reduced so that the whole volume of the folded chair cannot be reduced to the minimum.

BRIEF SUMMARY OF THE INVENTION

In accordance with the present invention, there is provided a foldable chair frame comprising two spaced leg units, two spaced backrest units, a connecting unit, and a linkage unit. Each of the leg units includes a front leg, and a rear leg pivotally connected with the front leg. The backrest units are adjacent to the leg units respectively and are movable relative to the leg units to adjust a reclining angle of the backrest units relative to the leg units. The connecting unit is pivotally connected between the leg units and can be collapsed to let the leg units approach each other. The linkage unit includes at least one link module pivotally connected between the backrest units. The link module includes two links pivotally connected with the backrest units respectively. Each of the links has a first pivot portion pivotally connected with one of the backrest units and a second pivot portion located opposite to the first pivot portion. The linkage unit is movable between an expanded position and a folded position. When the linkage unit is disposed at the expanded position, the link module substantially extends leftward and rightward. When the linkage unit is converted from the expanded position to the folded position, the second pivot portion of each of the links is moved upward gradually, and the first pivot portions of the links approach each other gradually. When the linkage unit is disposed at the folded position, the link module is bent so that the leg units are moved toward each other.

According to the primary advantage of the present invention, when the user wishes to fold the foldable chair frame, the leg units are moved toward each other, the backrest units are moved toward each other, the seat bars are moved toward the backrest units, the armrests are moved toward the backrest units, and the front leg and the rear leg of each of the leg units are moved toward each other, so that the foldable chair frame is folded in its longitudinal direction and is also folded in its transverse direction to reduce its whole volume to the minimum to facilitate the user storing the foldable chair frame.

According to another advantage of the present invention, the reclining angle of the backrest units can be adjusted freely to provide a comfortable sensation to the user.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
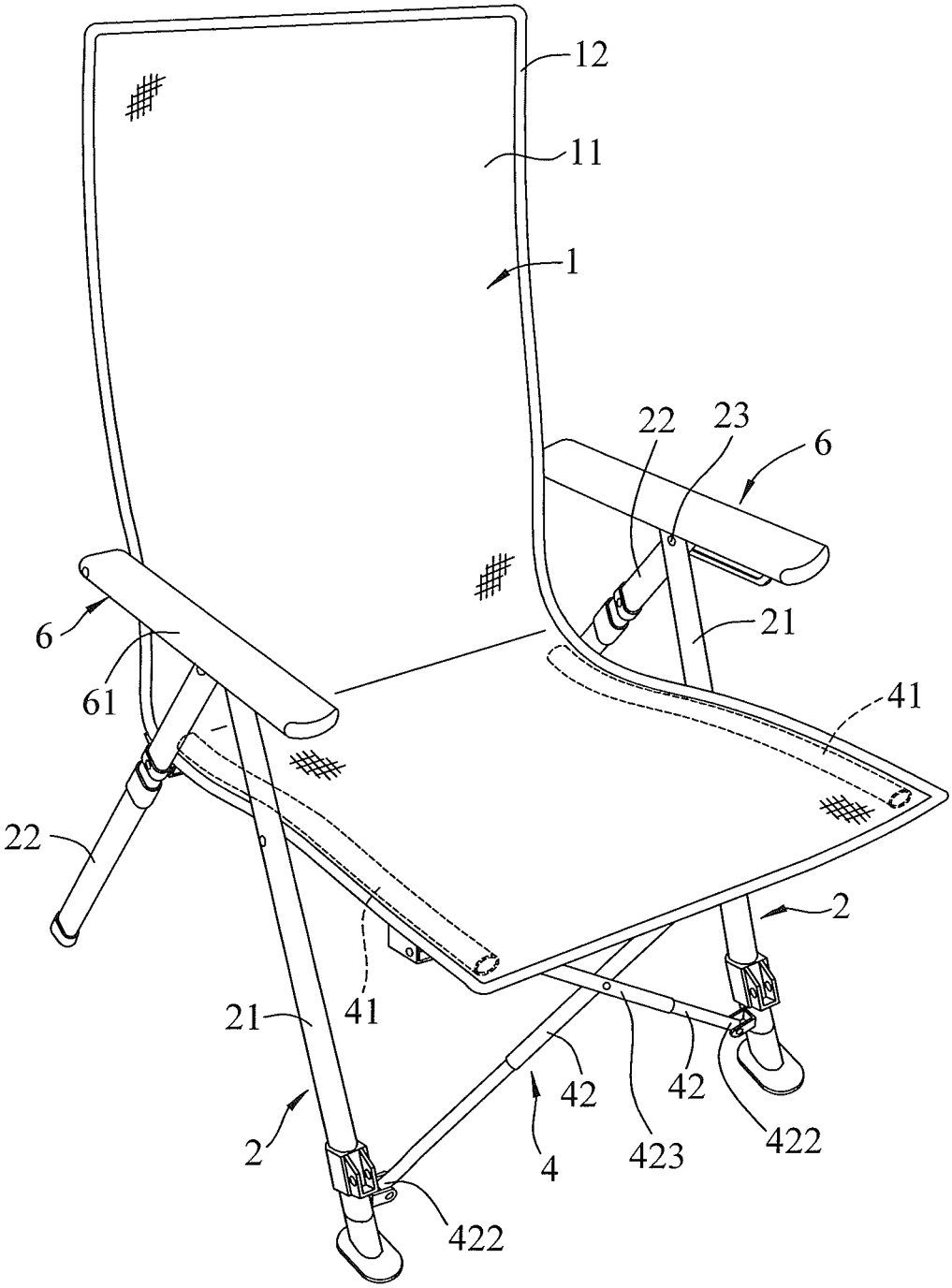
FIG. 1 is a front perspective view of a foldable chair frame in accordance with the preferred embodiment of the present invention.

Referring to the drawings and initially to FIGS. 1-5, a foldable chair frame is combined with a seating member 1 to construct a chair. The seating member 1 includes a cloth body 11 and a reinforcing rim 12 mounted on and combined with the periphery of the cloth body 11. The foldable chair frame in accordance with the preferred embodiment of the present invention comprises two spaced leg units 2, two spaced backrest units 3, a connecting unit 4, a linkage unit 5, and two spaced armrests 6.

Each of the leg units 2 includes a front leg 21 extending forward in an inclined manner, a rear leg 22 pivotally connected with the front leg 21 and extending backward in an inclined manner, and a pivot shaft 23 passing through a top of the front leg 21 and a top of the rear leg 22 and extending in a transverse direction.

The backrest units 3 are adjacent to the leg units 2 respectively and are pivotally connected with the armrests 6 respectively. Each of the backrest units 3 includes a backrest post 31 extending upward and downward, and a mounting base 32 mounted on the backrest post 31 and rotatable about a horizontal axis "L" which passes through a center of the mounting base 32.

The connecting unit 4 is pivotally connected between the leg units 2 and can be collapsed to let the leg units 2 approach each other. The connecting unit 4 includes two spaced seat bars 41 pivotally connected with the leg units 2 and the backrest units 3 respectively, and two cross braces 42 intersecting and pivotally connected with each other. Each of the seat bars 41 extends forward and is pivotally connected with the front leg 21 and the rear leg 22 of one of the leg units 2. Each of the cross braces 42 extends from one of the leg units 2 to the other one of the leg units 2. Each of the cross braces 42 has a top formed with a first connecting portion 421 pivotally connected with a mounting bracket 43 which is secured on one of the seat bars 41, a bottom formed with a second connecting portion 422 pivotally connected with a bottom of the front leg 21 of one of the leg units 2, and a mediate section formed with a third connecting portion 423 located between the first connecting portion 421 and the second connecting portion 422. The third connecting portions 423 of the cross braces 42 are pivotally connected with each other.

The linkage unit 5 includes two spaced link modules 51 pivotally connected between the backrest units 3 and a pull rod 52 connected with the link modules 51 and extending upward and downward.

Each of the link modules 51 includes two links 511 pivotally connected with the backrest units 3 respectively and extending leftward and rightward, and a movable pivoting support 512 mounted between the links 511. Each of the links 511 has a first pivot portion 513 pivotally connected with one of the backrest units 3 and a second pivot portion 514 located opposite to the first pivot portion 513 and pivotally connected with the movable pivoting support 512. Each of the links 511 of each of the link modules 51 of the linkage unit 5 is pivotable upward and downward with the first pivot portion 513 functioning as a fulcrum. The first pivot portion 513 of each of the links 511 of an upper one of the link modules 51 of the linkage unit 5 is pivotally connected with the mounting base 32 of one of the backrest units 3. In such a manner, the mounting base 32 of each of the backrest units 3 is rotatable relative to the backrest post 31 about the horizontal axis "L", so that the upper one of the link modules 51 of the linkage unit 5 can be pivoted in the upward and downward directions and can also be pivoted in other direction to facilitate folding of the foldable chair frame. The pull rod 52 includes two spaced driving portions 521 each pivotally connected with the movable pivoting support 512 of one of the link modules 51.

The armrests 6 are adjustably mounted on the leg units 2 respectively. Each of the armrests 6 has a rear end pivotally connected with the backrest post 31 of one of the backrest units 3. Each of the armrests 6 includes a top rail 61 located above the front leg 21 and the rear leg 22 of one of the leg units 2 and extending forward and backward, and a positioning plate 62 mounted on a bottom of the top rail 61 and provided with a plurality of locking grooves 621 spaced form each other. In assembly, the pivot shaft 23 of each of the leg units 2 extends into the positioning plate 62 of one of the armrests 6 and is selectively locked in one of the locking grooves 621 of the positioning plate 62.

In practice, the foldable chair frame is movable between an expanded state and a folded state. When the foldable chair frame is disposed at the expanded state, a user can be seated on the foldable chair frame. At this time, the backrest units 3 are driven by the armrests 6 to move relative to the leg units 2 so as to adjust the reclining angle of the backrest units 3 relative to the leg units 2.

Figure 2:
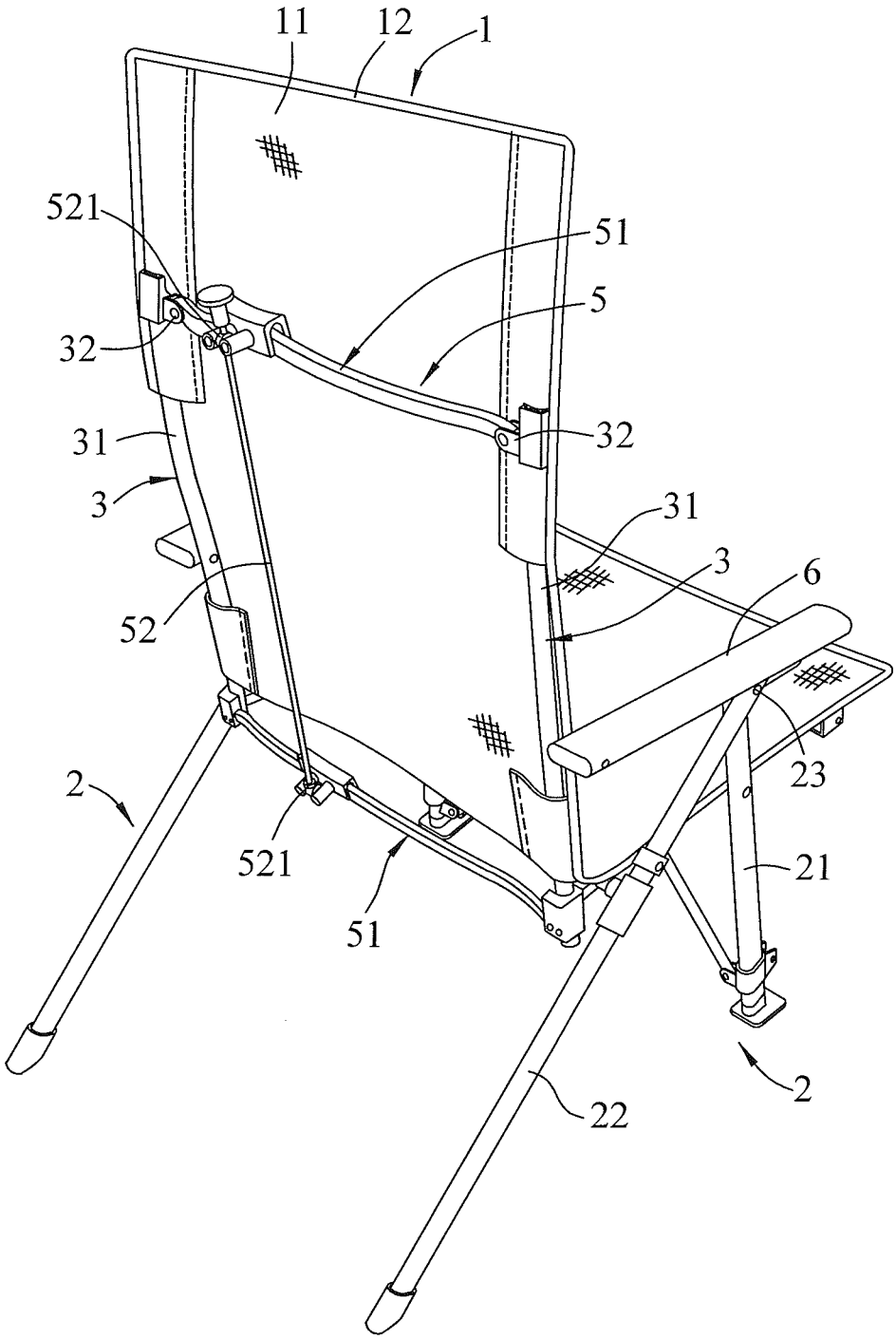
FIG. 2 is a rear perspective view of the foldable chair frame in accordance with the preferred embodiment of the present invention.
Figure 3:
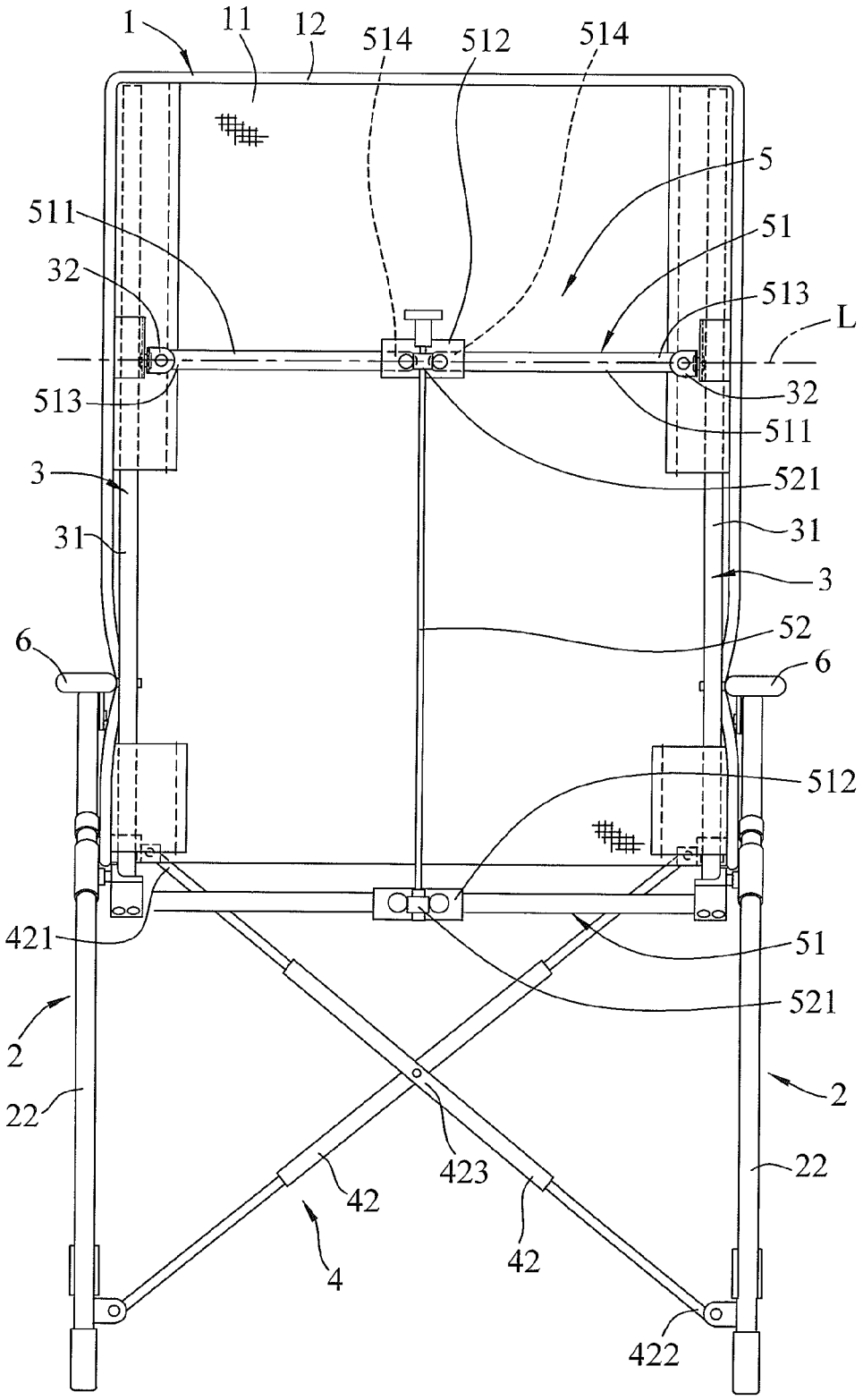
FIG. 3 is a rear view of the foldable chair frame as shown in FIG. 1.
Figure 4:
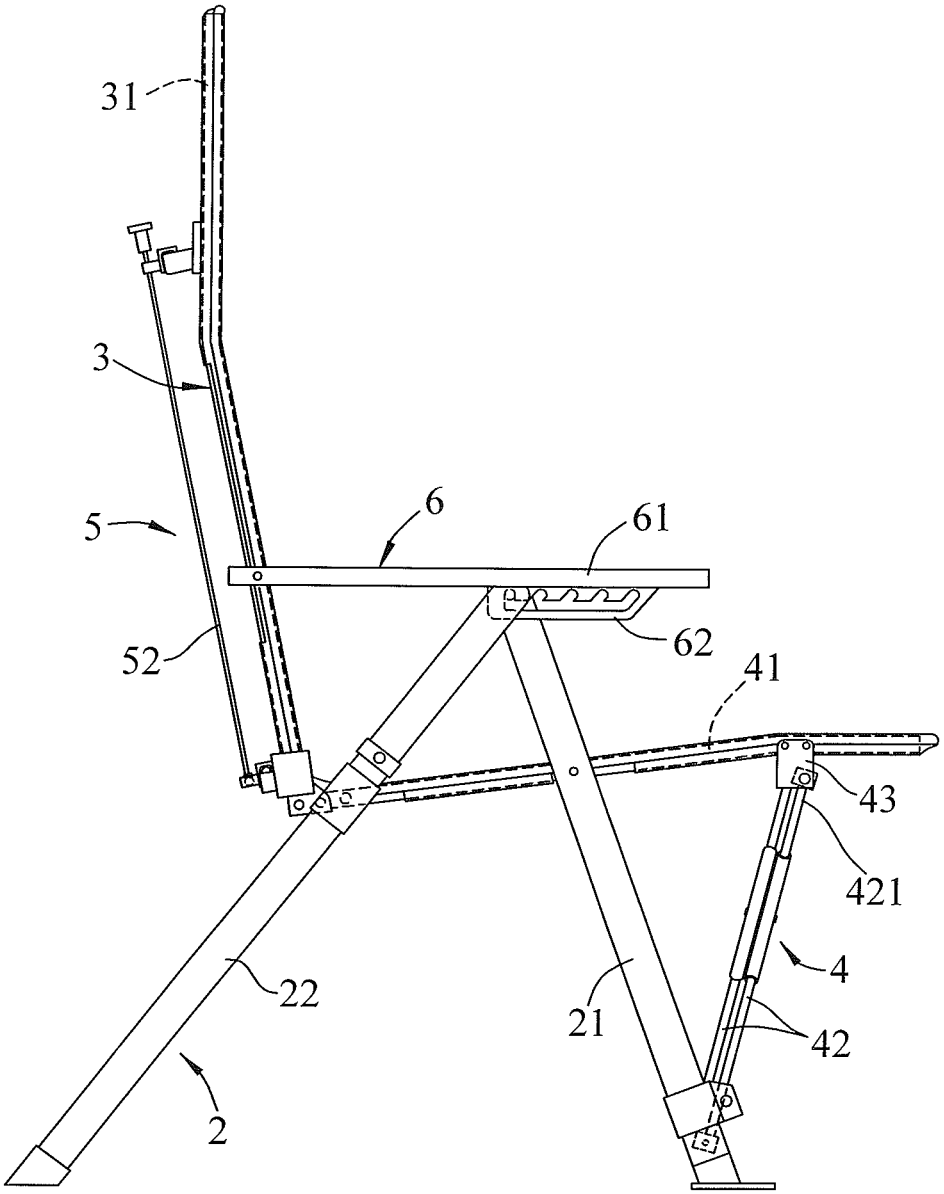
FIG. 4 is a side view of the foldable chair frame as shown in FIG. 1.
Figure 5:
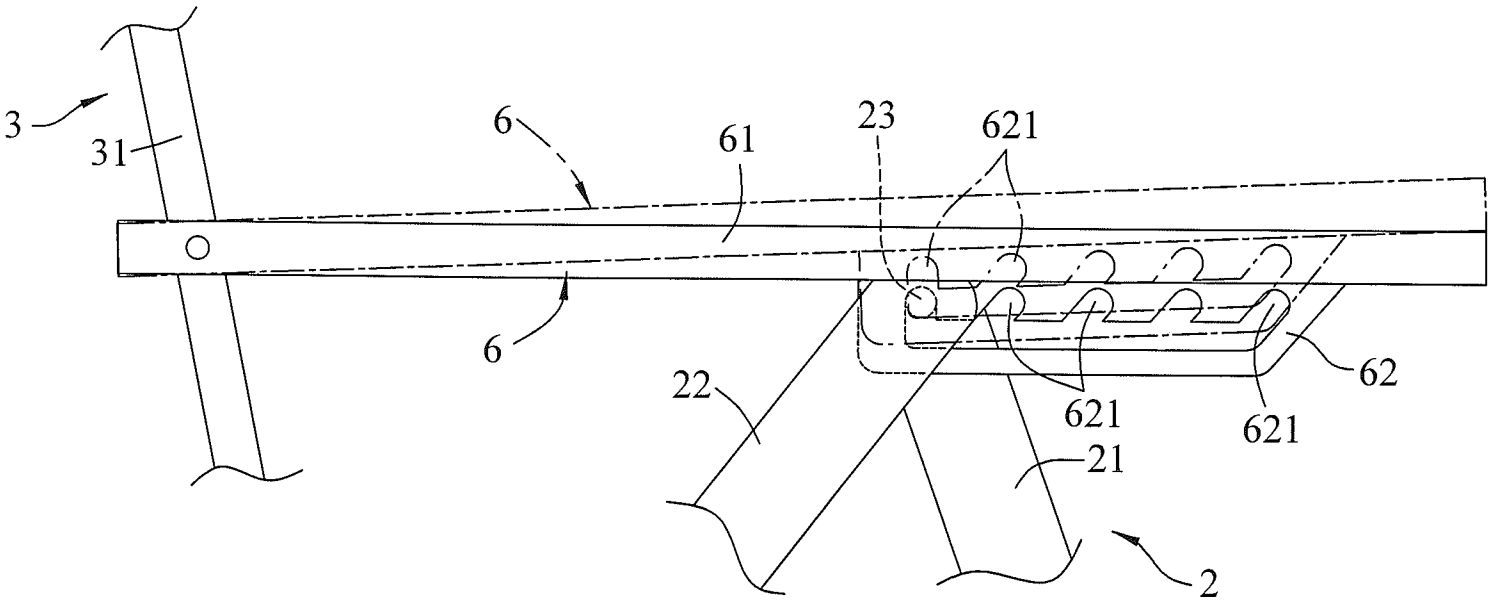
FIG. 5 is a locally enlarged operational view of the foldable chair frame as shown in FIG. 4 in adjustment of the reclining angle of the backrest units.
Figure 6:
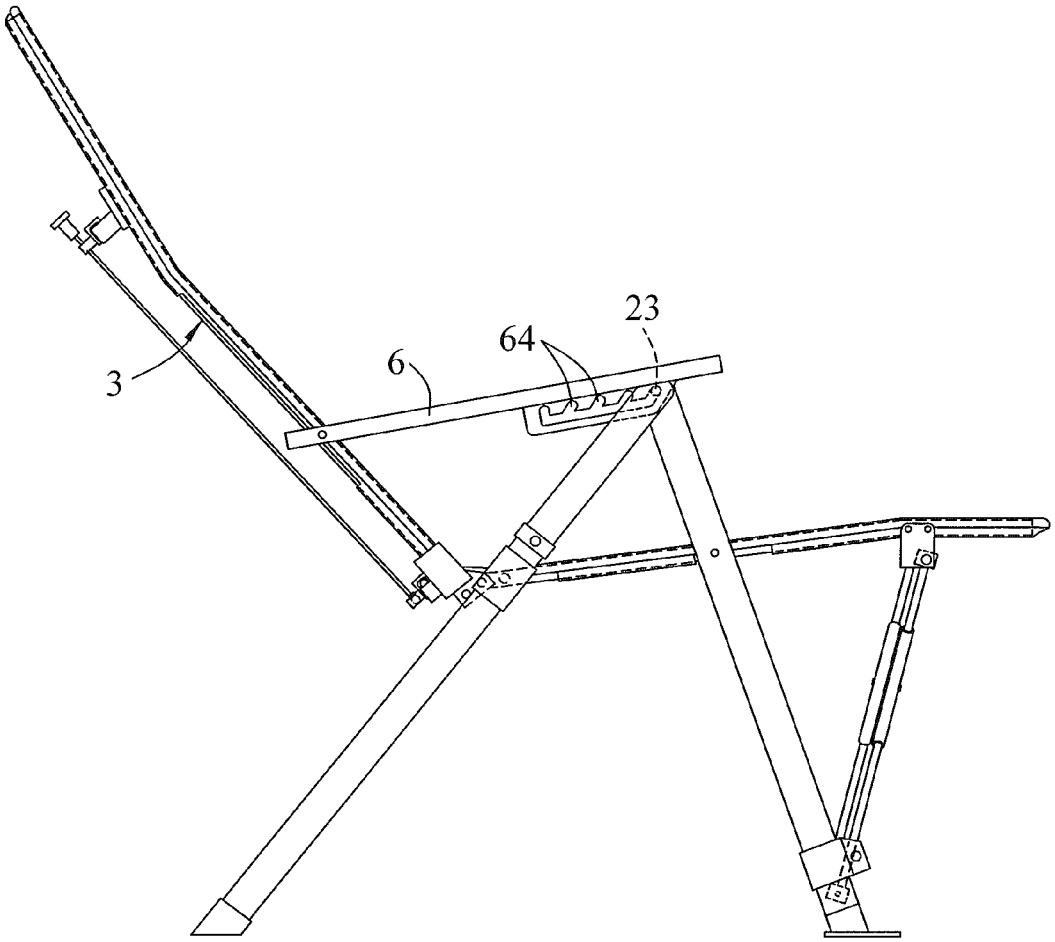
FIG. 6 is a schematic operational view of the foldable chair frame as shown in FIG. 4.

In adjustment, referring to FIGS. 4-6 with reference to FIGS. 1-3, the front end of each of the armrests 6 is lifted so that each of the armrests 6 is pivoted upward relative to the backrest post 31 of each of the backrest units 3 as shown in phantom lines in FIG. 5. In such a manner, the locking grooves 621 of the positioning plate 62 of each of the armrests 6 are located above the pivot shaft 23 of each of the leg units 2, so that the pivot shaft 23 of each of the leg units 2 is unlocked from one of the locking grooves 621 of the positioning plate 62 of each of the armrests 6, and each of the armrests 6 is unlocked from and can be moved forward and backward relative to each of the leg units 2. Then, each of the armrests 6 is pushed backward to drive each of the backrest units 3 to pivot backward until another one of the locking grooves 621 of the positioning plate 62 of each of the armrests 6 aligns with the pivot shaft 23 of each of the leg units 2. Then, each of the armrests 6 is pushed downward so that the pivot shaft 23 of each of the leg units 2 is locked in another one of the locking grooves 621 of the positioning plate 62 of each of the armrests 6. Thus, each of the backrest units 3 is driven by each of the armrests 6 to move from the position as shown in FIG. 4 to the position as shown in FIG. 6 so that the reclining angle of each of the backrest units 3 can be adjusted freely.

Figure 8:
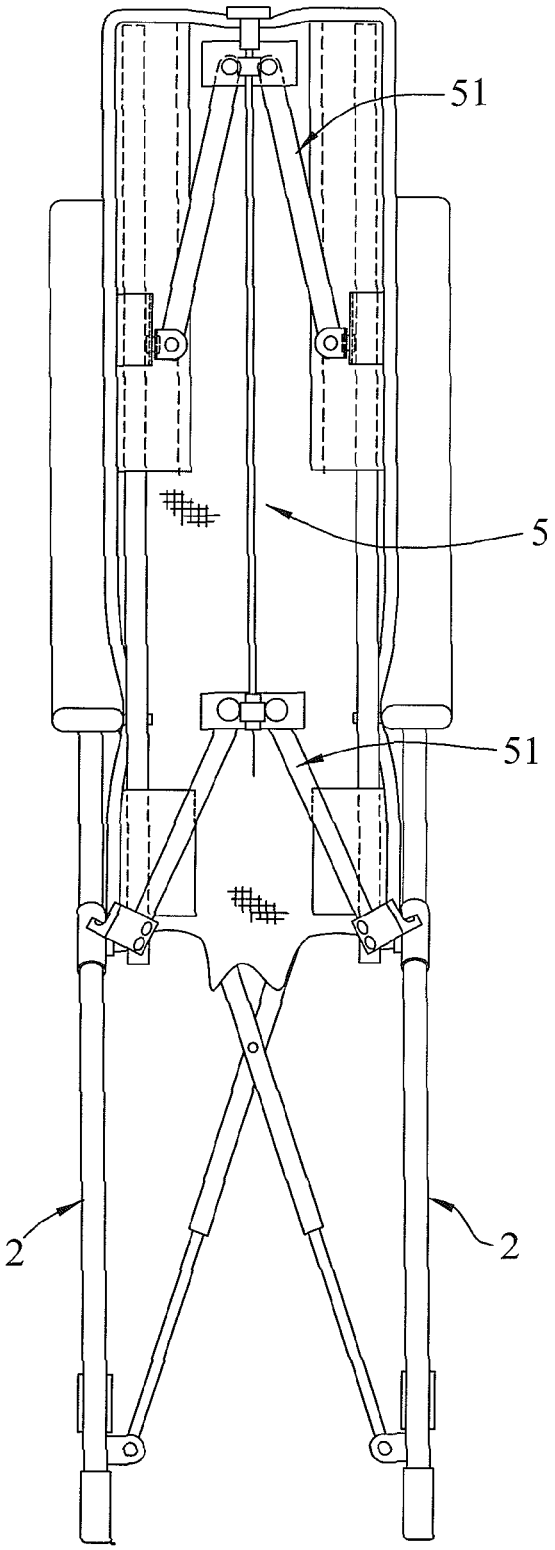
FIG. 8 is a folded view of the foldable chair frame as shown in FIG. 7.
Figure 9:
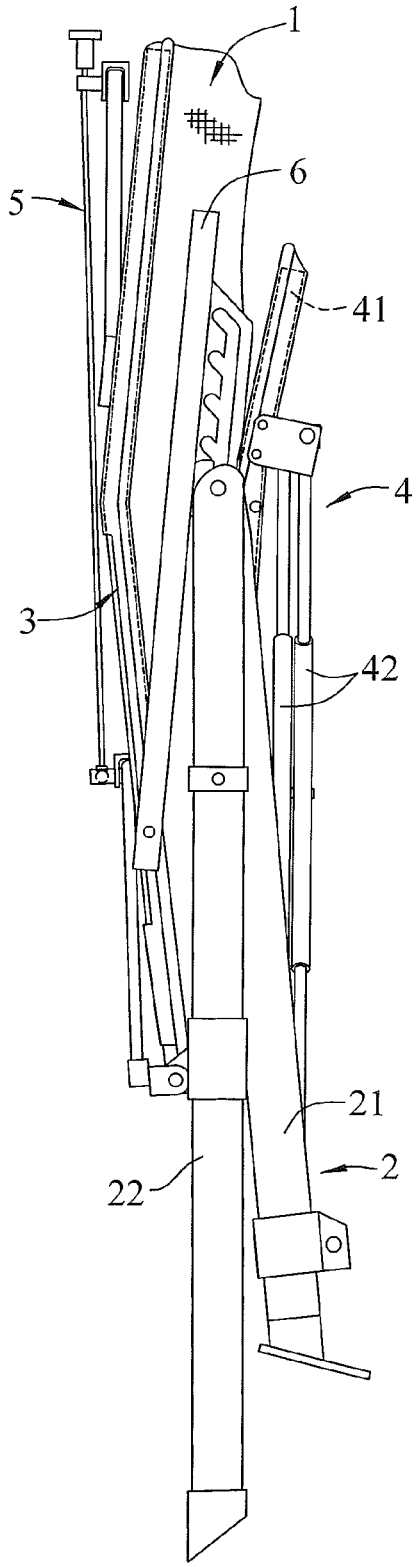
FIG. 9 is a folded view of the foldable chair frame as shown in FIG. 4.

In practice, when the foldable chair frame is movable between the expanded state as shown in FIGS. 1-4 and the folded state as shown in FIGS. 8 and 9, the linkage unit 5 is movable between an expanded position and a folded position.

Figure 7:
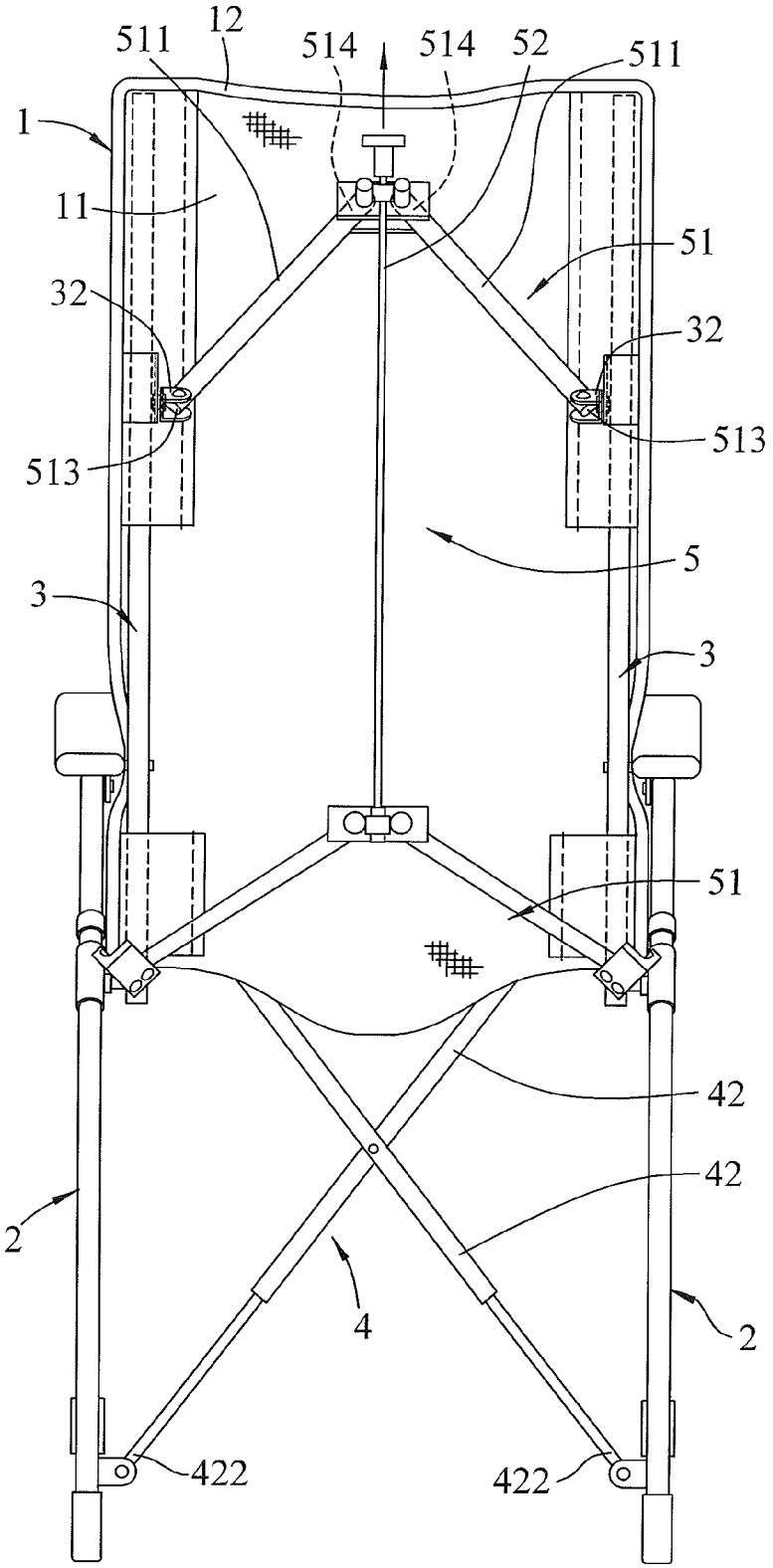
FIG. 7 is a folded view of the foldable chair frame as shown in FIG. 3.

In operation, referring to FIGS. 7-9 with reference to FIGS. 1-4, when the foldable chair frame is disposed at the expanded state, the linkage unit 5 is disposed at the expanded position. At this time, each of the links 511 of each of the link modules 51 of the linkage unit 5 is located at a horizontal state, so that each of the link modules 51 substantially extends leftward and rightward. When the pull rod 52 of the linkage unit 5 is pulled upward, each of the links 511 of each of the link modules 51 of the linkage unit 5 is pivoted upward, and each of the link modules 51 of the linkage unit 5 is bent gradually, so that the second pivot portion 514 of each of the links 511 is moved upward gradually, and the first pivot portions 513 of the links 511 approach each other gradually. In such a manner, the backrest units 3 are drawn by the linkage unit 5 to approach each other so that the leg units 2 are moved toward each other. Thus, the backrest units 3 are moved toward each other, and the leg units 2 are moved toward each other, so that the foldable chair frame is converted from the expanded state as shown in FIG. 3, through the semi-folded state as shown in FIG. 7 to the folded state as shown in FIG. 8. It is to be noted that, the mounting base 32 of each of the backrest units 3 is rotatable relative to the backrest post 31 about the horizontal axis "L", so that when the foldable chair frame is converted from the expanded state as shown in FIG. 3 to the semi-folded state as shown in FIG. 7, the mounting base 32 of each of the backrest units 3 is rotated through a determined angle, and the upper one of the link modules 51 of the linkage unit 5 is also rotated so as to fold the foldable chair frame conveniently. When the leg units 2 are moved toward each other, the cross braces 42 are pivoted, and the first connecting portion 421 of each of the cross braces 42 is driven to move the seat bars 41, so that the seat bars 41 are pivoted upward and moved toward the backrest units 3. When the seat bars 41 are pivoted upward, the front leg 21 and the rear leg 22 of each of the leg units 2 are moved toward each other, and the armrests 6 are pivoted upward and moved toward the backrest units 3. Thus, the foldable chair frame is converted from the expanded state as shown in FIG. 4 to the folded state as shown in FIG. 9.

Accordingly, when the user wishes to fold the foldable chair frame, the leg units 2 are moved toward each other, the backrest units 3 are moved toward each other, the seat bars 41 are moved toward the backrest units 3, the armrests 6 are moved toward the backrest units 3, and the front leg 21 and the rear leg 22 of each of the leg units 2 are moved toward each other, so that the foldable chair frame is folded in its longitudinal direction and is also folded in its transverse direction to reduce its whole volume to the minimum to facilitate the user storing the foldable chair frame. In addition, the reclining angle of the backrest units 3 can be adjusted freely to provide a comfortable sensation to the user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A foldable chair frame comprising:

two spaced leg units, two spaced backrest units, a connecting unit, and a linkage unit, wherein:

each of the two spaced leg units includes a front leg and a rear leg pivotally connected with the front leg;

the two spaced backrest units are adjacent to the two spaced leg units respectively and are movable relative to the two spaced leg units to adjust a reclining angle of the two spaced backrest units relative to the two spaced leg units;

the connecting unit is pivotally connected between the two spaced leg units and is collapsible to let the two spaced leg units approach each other;

the linkage unit includes two spaced link modules pivotally connected between the two spaced backrest units and a pull rod connected with the two spaced link modules and extending upward and downward;

each link module includes two links pivotally connected with the two spaced backrest units respectively;

each of the two links has a first pivot portion pivotally connected with one of the two spaced backrest units and a second pivot portion located opposite to the first pivot portion;

the linkage unit is movable between an expanded position and a folded position;

when the linkage unit is disposed at the expanded position, each link module substantially extends leftward and rightward;

when the linkage unit is converted from the expanded position to the folded position, the second pivot portion of each of the two links is moved upward gradually, and the first pivot portions of the two links approach each other gradually;

when the linkage unit is disposed at the folded position, each link module is bent so that the two spaced leg units are moved toward each other; and when the linkage unit is disposed at the expanded position, the pull rod is pulled upward to drive the second pivot portions of the two links to move upward so that the linkage unit is converted from the expanded position to the folded position.

2. The foldable chair frame of claim 1, wherein:

each of the two spaced link modules further includes a movable pivoting support mounted between the two links;

the second pivot portion of each of the two links is pivotally connected with the movable pivoting support; and the pull rod includes two spaced driving portions each pivotally connected with the movable pivoting support of one of the two spaced link modules.

3. The foldable chair frame of claim 1, wherein:

the connecting unit includes two cross braces intersecting and pivotally connected with each other; and each of the two cross braces is pivotally connected with the front leg of one of the two spaced leg units.

4. The foldable chair frame of claim 1, wherein:

the foldable chair frame further comprises two spaced armrests;

each of the two spaced armrests has a rear end pivotally connected with one of the two spaced backrest units; and the two spaced armrests are adjustably mounted on the two spaced leg units respectively.

5. A foldable chair frame comprising:

two spaced leg units, two spaced backrest units, a connecting unit, and a linkage unit, wherein:

each of the two spaced leg units includes a front leg and a rear leg pivotally connected with the front leg;

the two spaced backrest units are adjacent to the two spaced leg units respectively and are movable relative to the two spaced leg units to adjust a reclining angle of the two spaced backrest units relative to the two spaced leg units;

the connecting unit is pivotally connected between the two spaced leg units and is collapsible to let the two spaced leg units approach each other;

the connecting unit includes two cross braces intersecting and pivotally connected with each other and two spaced seat bars pivotally connected with the two spaced leg units respectively;

each of the two cross braces is pivotally connected with the front leg of one of the two spaced leg units;

each of the two spaced seat bars extends forward and is pivotally connected with one of the two cross braces;

the linkage unit includes a link module pivotally connected between the two spaced backrest units;

the link module includes two links pivotally connected with the two spaced backrest units respectively;

each of the two links has a first pivot portion pivotally connected with one of the two spaced backrest units and a second pivot portion located opposite to the first pivot portion;

the linkage unit is movable between an expanded position and a folded position;

when the linkage unit is disposed at the expanded position, the link module substantially extends leftward and rightward;

when the linkage unit is converted from the expanded position to the folded position, the second pivot portion of each of the two links is moved upward gradually, and the first pivot portions of the two links approach each other gradually; and when the linkage unit is disposed at the folded position, the link module is bent so that the two spaced leg units are moved toward each other.

6. The foldable chair frame of claim 5, wherein the at least one link module includes two spaced link modules pivotally connected between the two spaced backrest units.

7. The foldable chair frame of claim 6, wherein:

each of the two spaced backrest units includes:

a backrest post; and a mounting base mounted on the backrest post and rotatable about a horizontal axis; and the first pivot portion of each of the two links of an upper one of the two spaced link modules of the linkage unit is pivotally connected with the mounting base of one of the two spaced backrest units.

8. A foldable chair frame comprising:

two spaced leg units, two spaced backrest units, a connecting unit, a linkage unit and two spaced armrests, wherein:

each of the two spaced leg units includes a front leg and a rear leg pivotally connected with the front leg;

the two spaced backrest units are adjacent to the two spaced leg units respectively and are movable relative to the two spaced leg units to adjust a reclining angle of the two spaced backrest units relative to the two spaced leg units;

the connecting unit is pivotally connected between the two spaced leg units and is collapsible to let the two spaced leg units approach each other;

each of the two spaced armrests has a rear end pivotally connected with one of the two spaced backrest units;

the two spaced armrests are adjustably mounted on the two spaced leg units respectively;

each of the two spaced armrests includes:

a top rail located above the front leg and the rear leg of one of the two spaced leg units; and a positioning plate mounted on a bottom of the top rail and provided with a plurality of locking grooves spaced from each other;

each of the two spaced leg units further includes a pivot shaft pivotally connected with a top of the front leg and a top of the rear leg;

the pivot shaft of each of the two spaced leg units is selectively locked in one of the plurality of locking grooves of the positioning plate;

the linkage unit includes a link module pivotally connected between the two spaced backrest units;

the link module includes two links pivotally connected with the two spaced backrest units respectively;

each of the two links has a first pivot portion pivotally connected with one of the two spaced backrest units and a second pivot portion located opposite to the first pivot portion;

the linkage unit is movable between an expanded position and a folded position;

when the linkage unit is disposed at the expanded position, the link module substantially extends leftward and rightward;

when the linkage unit is converted from the expanded position to the folded position, the second pivot portion of each of the two links is moved upward gradually, and the first pivot portions of the two links approach each other gradually; and when the linkage unit is disposed at the folded position, the link module is bent so that the two spaced leg units are moved toward each other.

* * * * *